US010046595B2

(12) United States Patent
Reynolds

(10) Patent No.: US 10,046,595 B2
(45) Date of Patent: Aug. 14, 2018

(54) HANDS-FREE PAINT HOLDER

(71) Applicant: Duane Reynolds, Avon, IN (US)

(72) Inventor: Duane Reynolds, Avon, IN (US)

( * ) Notice: Subject to any disclaimer, the term of this patent is extended or adjusted under 35 U.S.C. 154(b) by 0 days.

(21) Appl. No.: 15/648,689

(22) Filed: Jul. 13, 2017

(65) Prior Publication Data

US 2018/0015779 A1 Jan. 18, 2018

Related U.S. Application Data

(60) Provisional application No. 62/361,709, filed on Jul. 13, 2016.

(51) Int. Cl.

| | |
|---|---|
| ***B44D 3/24*** | (2006.01) |
| ***B44D 3/12*** | (2006.01) |
| ***B44D 3/00*** | (2006.01) |
| ***B44D 3/14*** | (2006.01) |
| ***A45F 3/00*** | (2006.01) |
| ***A45F 5/02*** | (2006.01) |
| ***A45F 3/14*** | (2006.01) |

(52) U.S. Cl.

CPC ..... *B44D 3/24* (2013.01); *A45F 3/00* (2013.01); *A45F 3/14* (2013.01); *A45F 5/021* (2013.01); *B44D 3/123* (2013.01); *B44D 3/14* (2013.01); *A45F 2003/008* (2013.01); *A45F 2003/144* (2013.01); *A45F 2200/0575* (2013.01)

(58) Field of Classification Search

CPC ..... Y10S 224/904; A45F 5/021; A45F 5/02; A45F 2200/0575; A45F 5/00; A45F 2005/026; A45F 5/10; B44D 3/14; B44D 3/24; B44D 3/121

USPC ..... 224/197, 904

See application file for complete search history.

(56) References Cited

U.S. PATENT DOCUMENTS

| | | | | |
|---|---|---|---|---|
| 1,109,161 A * | 9/1914 | Chindgren | A45F 3/14 217/28 |
| 6,006,966 A * | 12/1999 | Voisin, Jr. | B44D 3/14 224/148.4 |
| 6,283,345 B1 * | 9/2001 | Butschat | A45F 5/02 224/148.4 |
| 6,557,738 B1 * | 5/2003 | Meintzer | A45F 5/00 224/148.7 |

* cited by examiner

*Primary Examiner* — Adam Waggenspack

(74) *Attorney, Agent, or Firm* — C. John Brannon; Brannon Sowers & Cracraft PC

(57) ABSTRACT

A hands-free, belt-worn paint container support apparatus including a receptacle for holding a paint container, a handle rotatably connected to the receptacle, one or more spacers rotatably connected to the handle, a belt tab connected to the spacers, and first and second spaced panels operationally connected to the spacers, where each panel is connected to the spacers, where the handle is rotatably connected to the first side panel, and where the belt tab is connected to the second side panel. In additional embodiments, the belt may be configured to accommodate paint trays as well as paint holders.

5 Claims, 11 Drawing Sheets

HANDS-FREE PAINT HOLDER

CROSS-REFERENCE TO RELATED APPLICATIONS

This application claims the benefit under 35 U.S.C. § 119(e) of U.S. Patent Application No. 62/361,709, filed on Jul. 13, 2016, which is incorporated herein by reference in its entirety.

TECHNICAL FIELD

The present novel technology relates generally to commercial painting structure, and, more particularly, to a hands-free paint container holder.

BACKGROUND

Painting or repainting walls of houses and like structures is an important aspect in home maintenance and improvement. Homeowners themselves are trending towards engaging in "do-it-yourself" home upkeep, maintenance, and repair painting projects that might otherwise be reserved for home improvement professionals. While painting itself is not inherently dangerous, climbing a ladder, or painting at elevated and/or unstable locations, can render painting hazardous for the average homeowner, or even for the seasoned professional. The hazard in the aforementioned painting often results from the painter climbing a ladder with only one free hand, while the other hand is carrying a paint can or tray.

Thus, there is a need for a paint holder that allows the painter to climb a ladder without forfeiting function of either hand. The present novel technology addresses this need.

Figure 1:
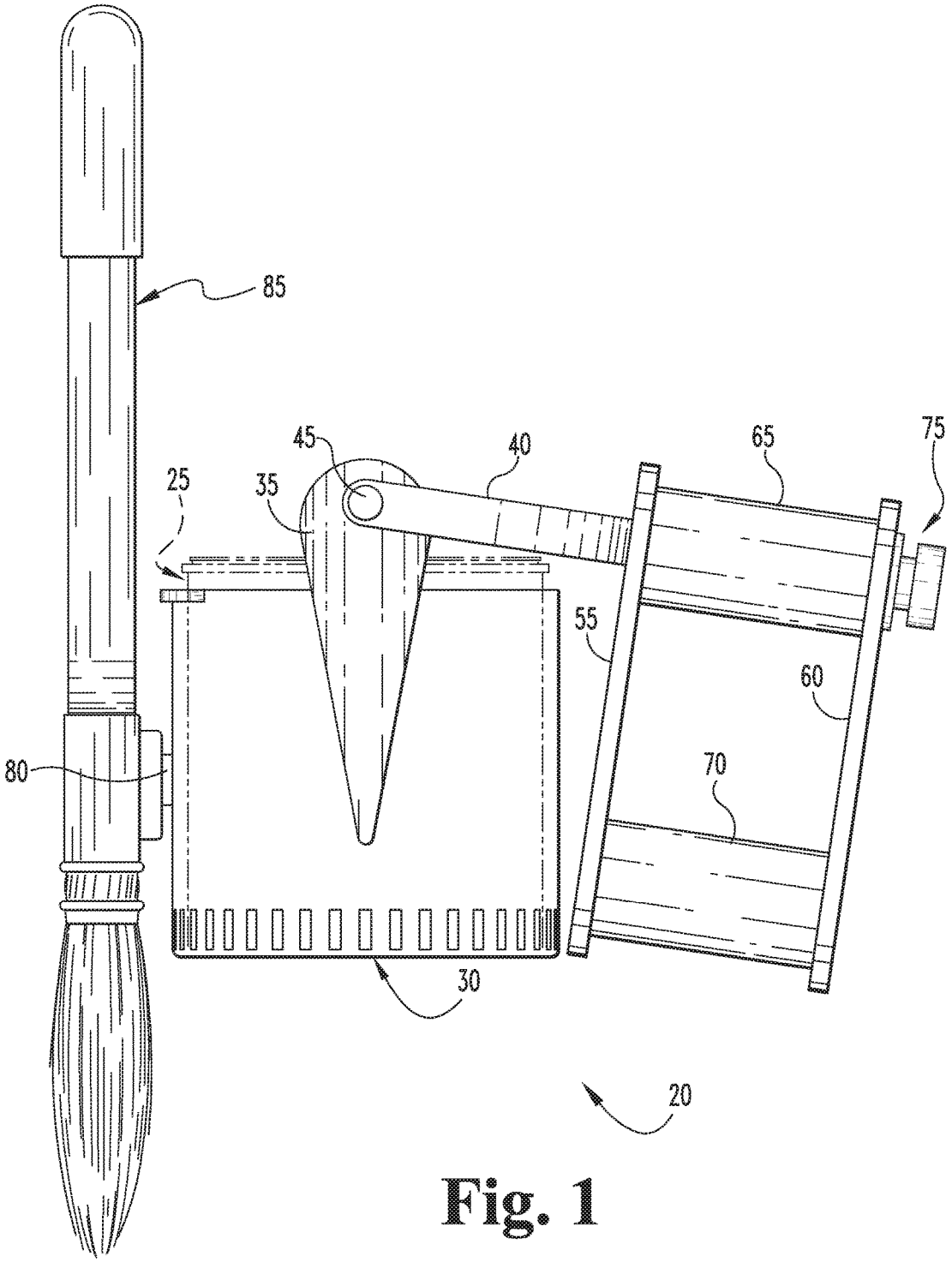
FIG. 1 is a perspective view from the side of the paint holder.

The details of one or more embodiments of the subject matter described in this specification are set forth in the accompanying drawings and the description below. Other features, aspects, and advantages of the subject matter will become apparent from the description, the drawings, and the claims.

Like reference numbers and designations in the various drawings indicate like elements.

DETAILED DESCRIPTION

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

As used in the specification and the claims, the singular forms "a," "an" and "the" include plural referents unless the context clearly dictates otherwise. Ranges may be expressed in ways including from "about" one particular value, and/or to "about" another particular value. When such a range is expressed, another implementation may include from the one particular value and/or to the other particular value. Similarly, when values are expressed as approximations, for example by use of the antecedent "about," it will be understood that the particular value forms another implementation. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not. Similarly, "typical" or "typically" means that the subsequently described event or circumstance often though may not occur, and that the description includes instances where said event or circumstance occurs and instances where it does not.

Figure 2:
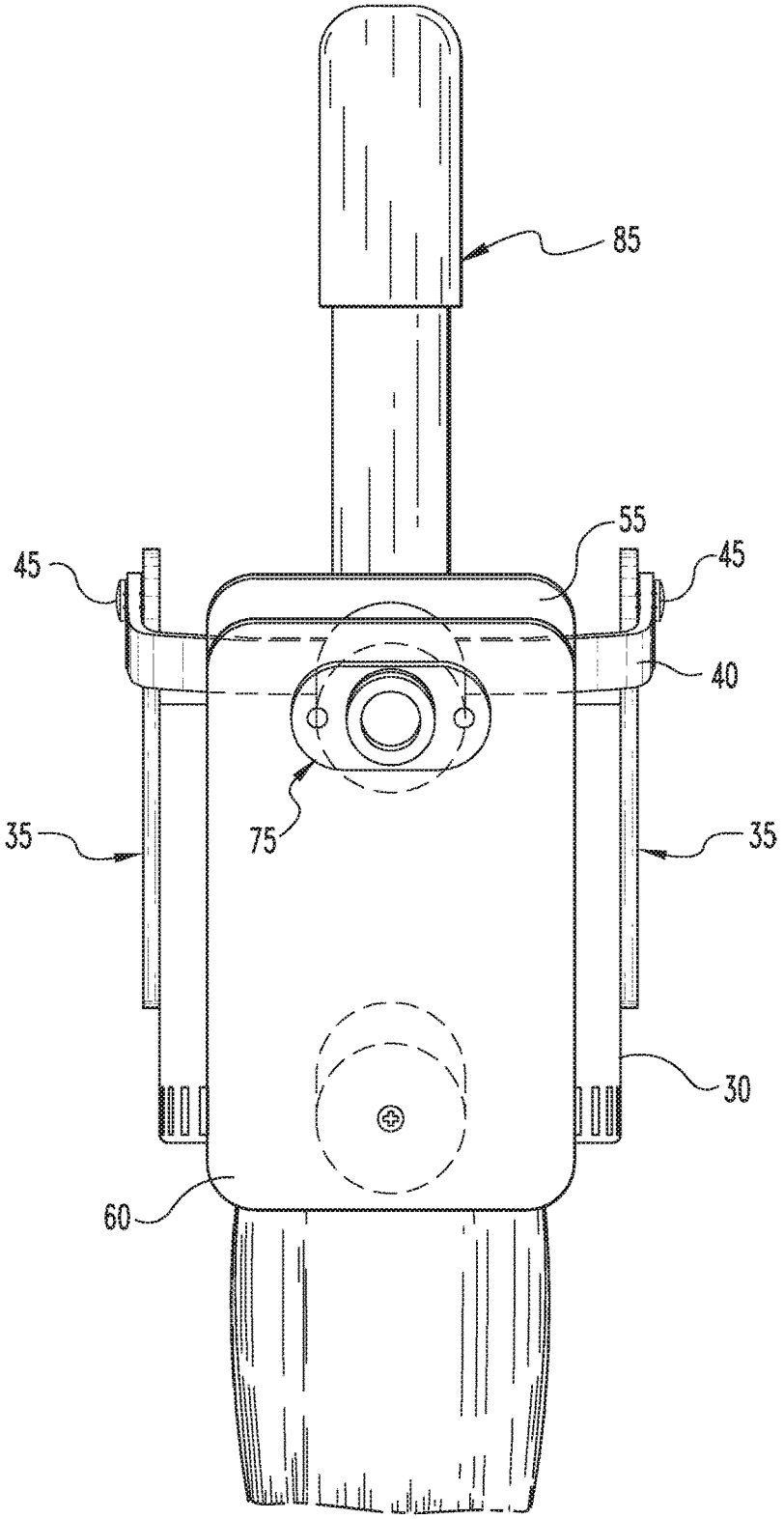
FIG. 2 is a perspective view of the back side of the spacer with a belt clip attachment.
Figure 3:
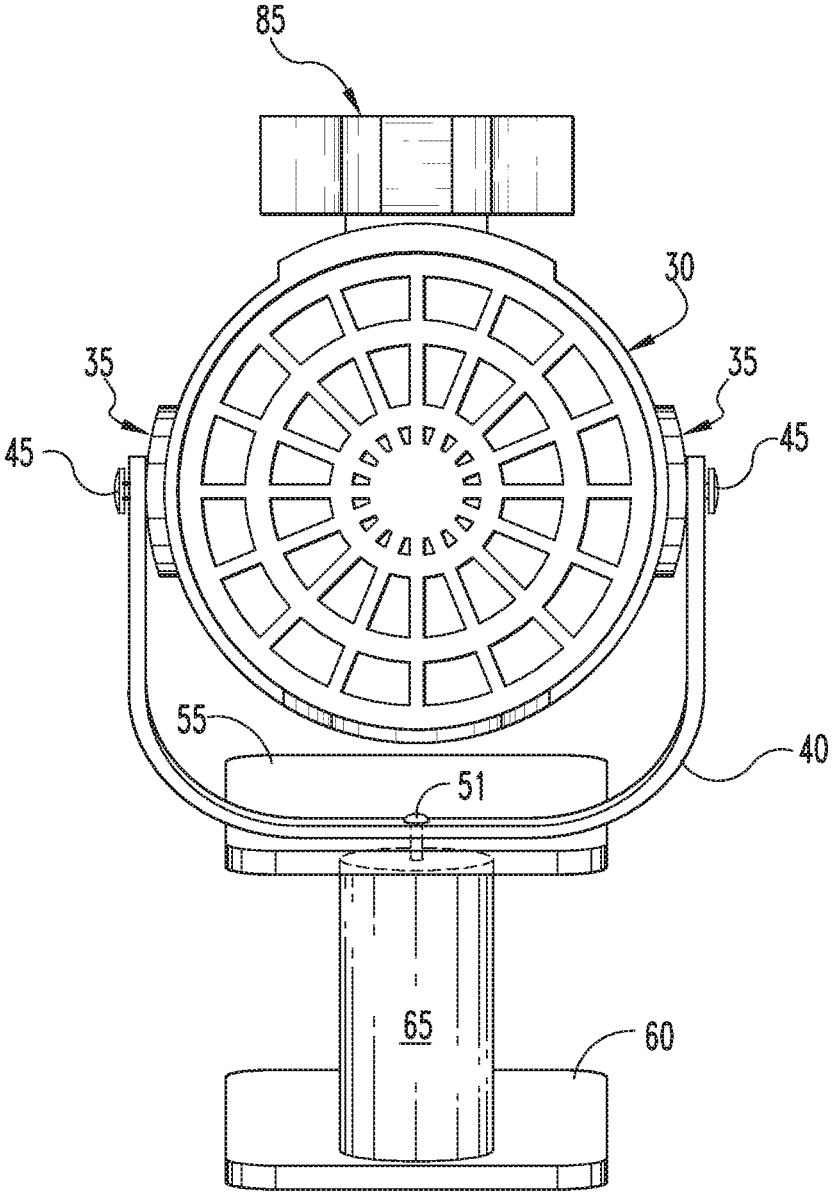
FIG. 3 is a top view of the embodiment of FIG. 1.
Figure 4:
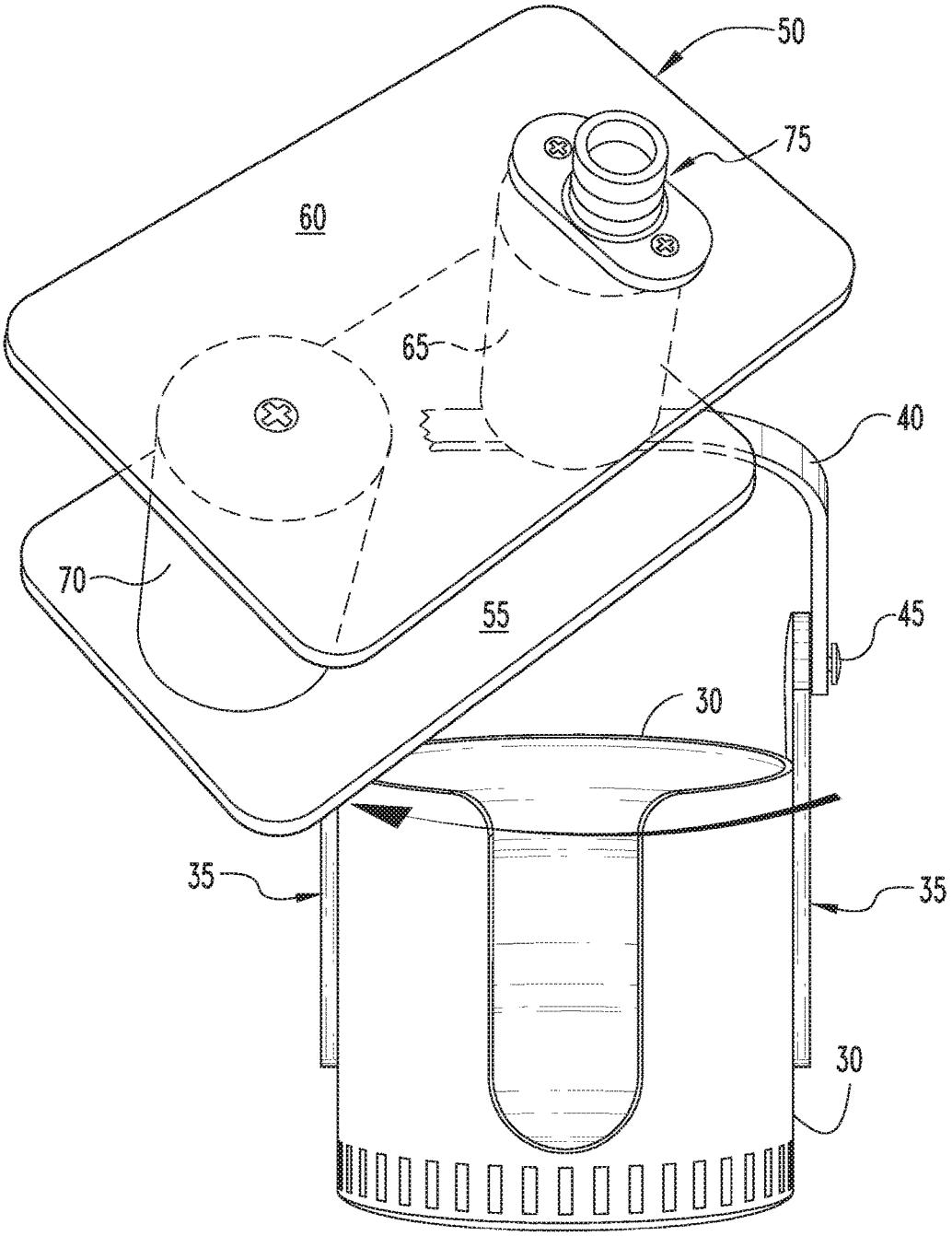
FIG. 4 is a perspective view of the embodiment of FIG. 1.
Figure 5:
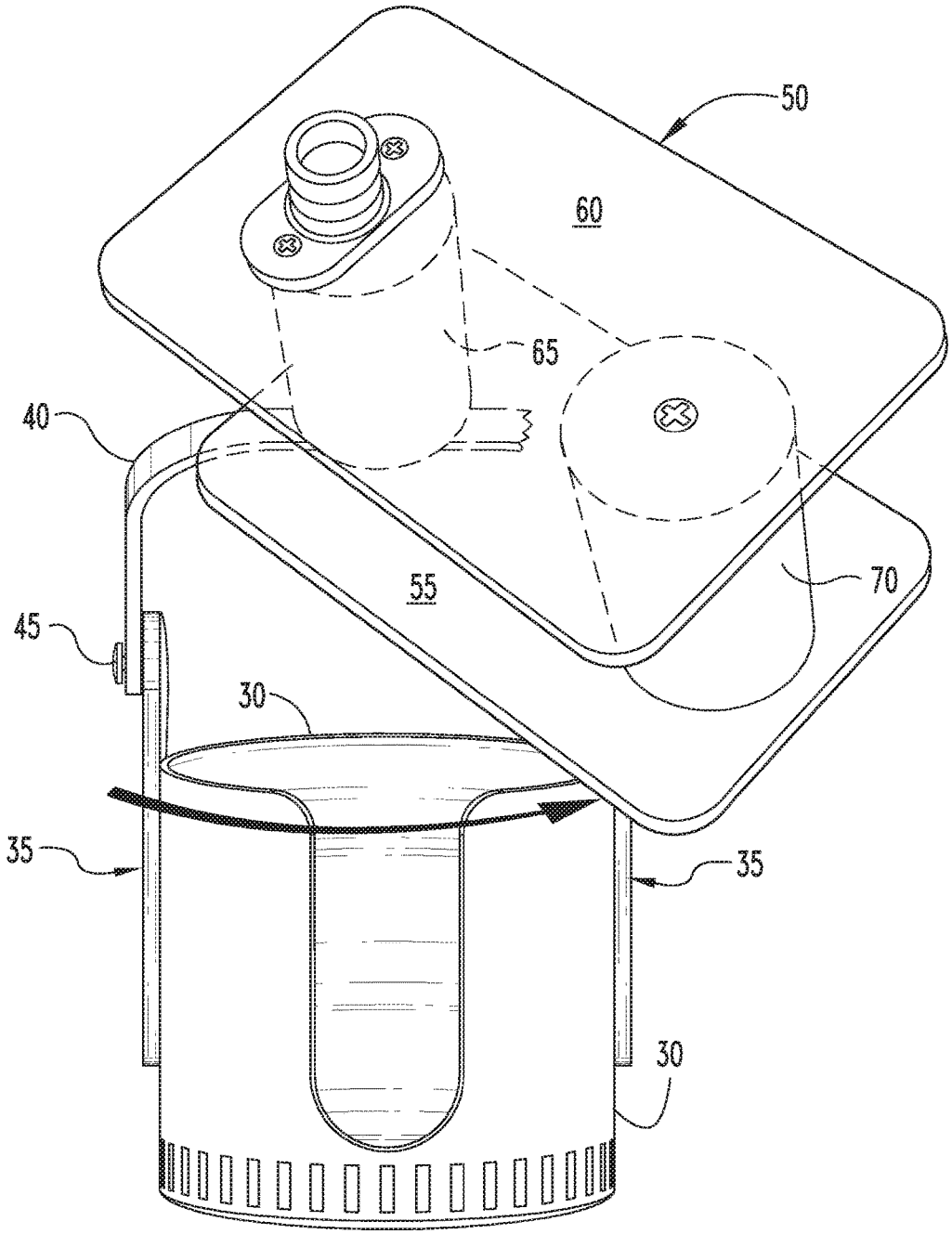
FIG. 5 is a perspective view of the embodiment of FIG. 1.

The novel technology shown in FIGS. 1-5 typically is a portable paint holder system 20 including a can or cup holder portion 30, a handle portion 40, and a spacer portion 50. The paint cup holder 30 is typically tapered with an opening slightly or marginally larger than the size of a sixteen to thirty-two ounce can used for holding paint, such that the user may place most standard cups, cans, and/or like receptacles 25 inside the holder 30. Connected to either side of the holder 30 are two, typically tear-drop-shaped, side pieces 35. The side pieces 35 extend upward, typically about one to two inches above the rim of the holder 30. The handle portion 40 is pivotably connected to the either side piece 35 defining a point of connection 45, such that it may pivot about the point of connection 45, typically through more than one hundred and eighty degrees.

The spacer portion 50 is operationally connected to the handle portion 40, typically at its center. The spacer portion 50 typically consists of a proximal spacer panel 55 and distal spacer panel 60. The panels 55, 60 are typically rectangular shape, and are connected via top panel connector 65 and bottom connector 70. The connectors 65, 70 are typically cylindrical pieces more typically about one to two inches in length. These connectors 65, 70 create space between the two panels 55, 60 such that the holder 30 is typically kept at a one-inch to three-inch distance from the user's body. The handle 40 is typically, rotatably connected to the proximal spacer panel 55 near the top panel connector 65. The spacer 50 can rotate freely about this point of connection 51.

The belt connector 75 is attached to the back of the distal panel 60 near the top panel connector 65. This tab 75 typically allows the user to clip the apparatus 20 onto their belt, pants, or receiving clip.

In other embodiments, the spacer portion 50 may include one or more cylindrical panel connectors 65, 70.

In other embodiments, the apparatus 20 may include a magnet 80 that is attached to the cup holder 30. This allows the user to magnetically connect a paint brush 85 to the side of the holder 30.

In operation, pivoting or rotating about the two aforementioned points of connection 45, 51 allows for the bottom of the cup holder 30 to remain substantially parallel to the ground. As the user moves up and down the ladder, and from side-to-side while painting, this pivoting or rotating of the cup holder 30 allows the cup/can 25 to remain upright to prevent the paint from spilling, while giving the user a free hand to better climb and stabilize themselves on a ladder.

Figure 6:
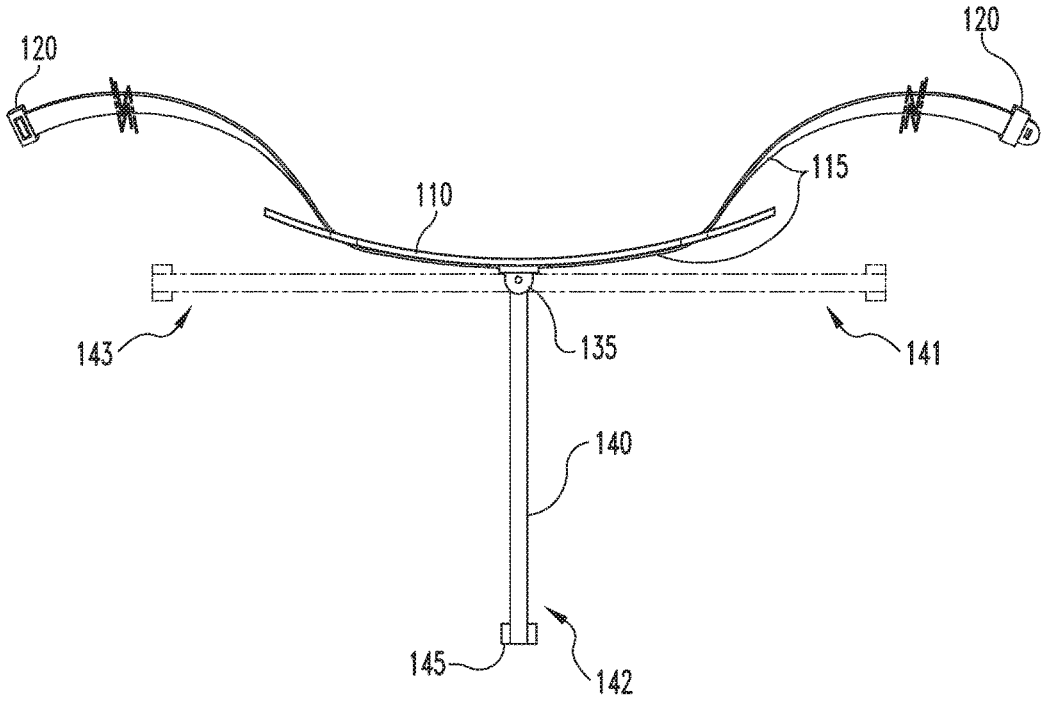
FIG. 6 is a top view of a harness embodiment.
Figure 7:
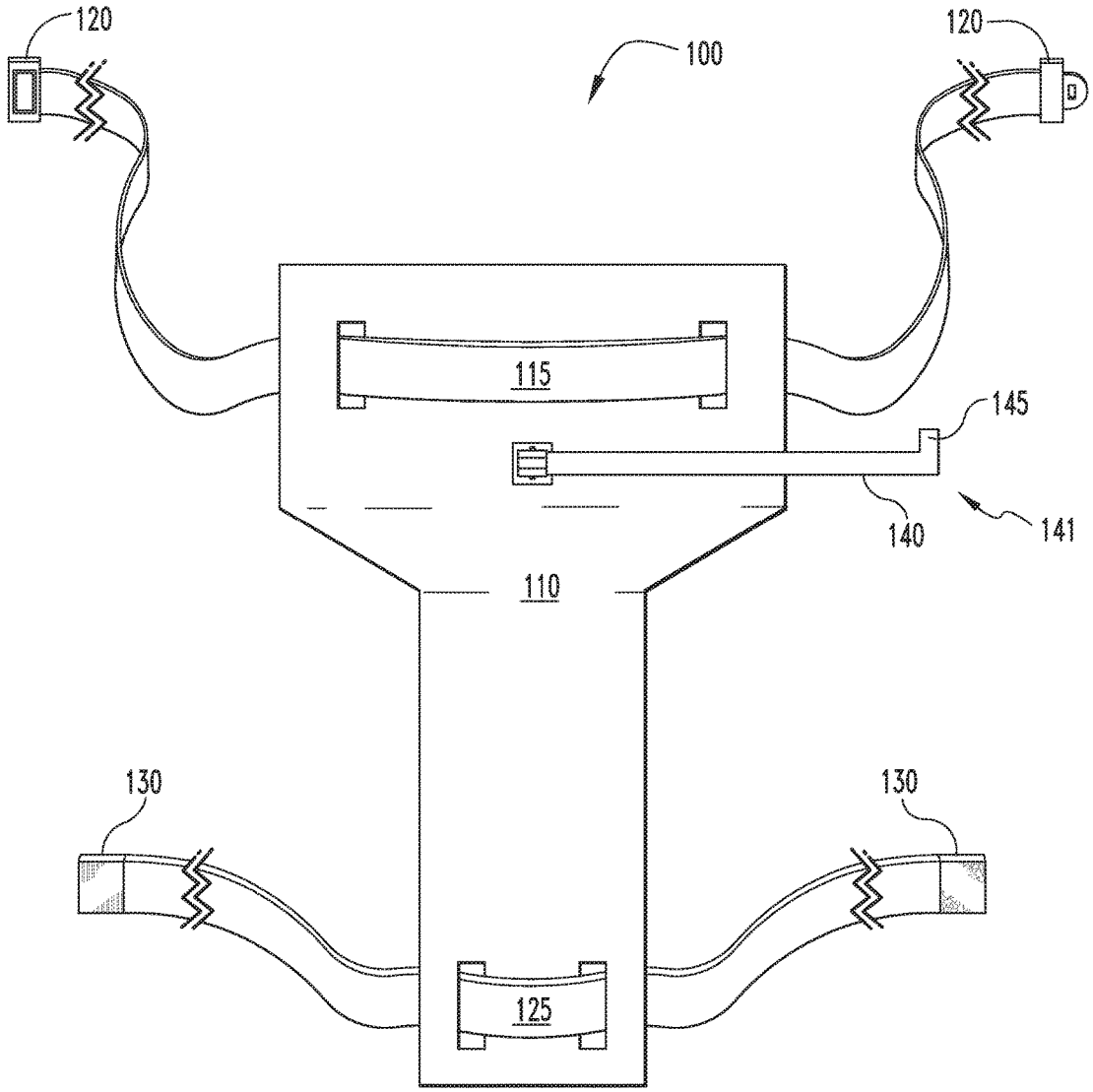
FIG. 7 is a side view of the embodiment of FIG. 6.
Figure 8:
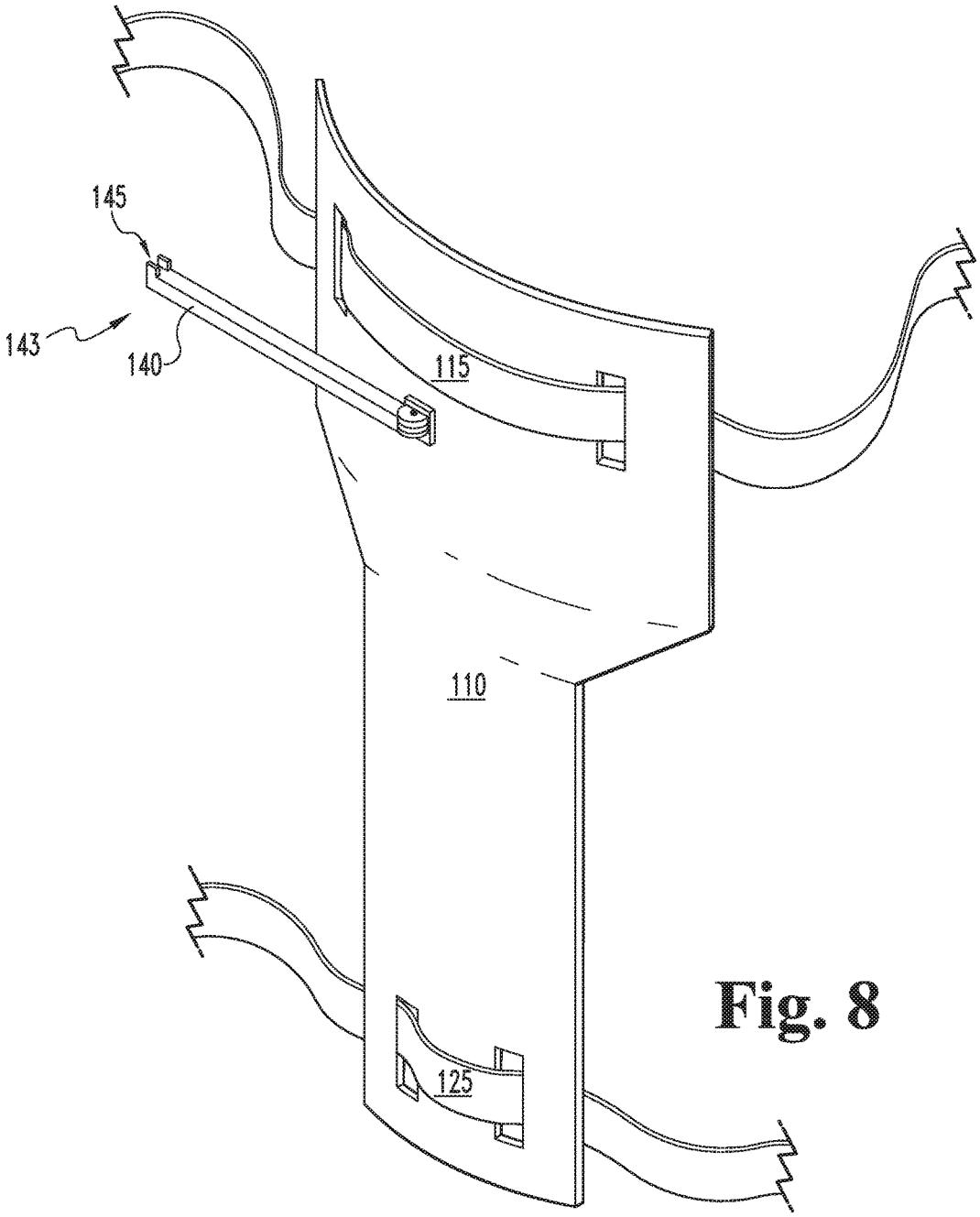
FIG. 8 is a perspective view of the embodiment of FIG. 6.
Figure 9:
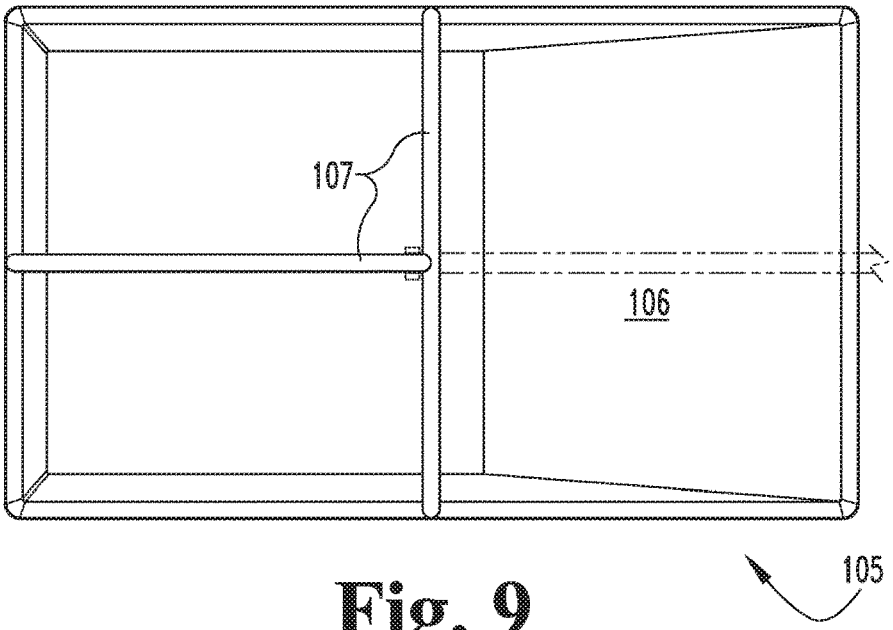
FIG. 9 is a top view of a paint tray.
Figure 10:
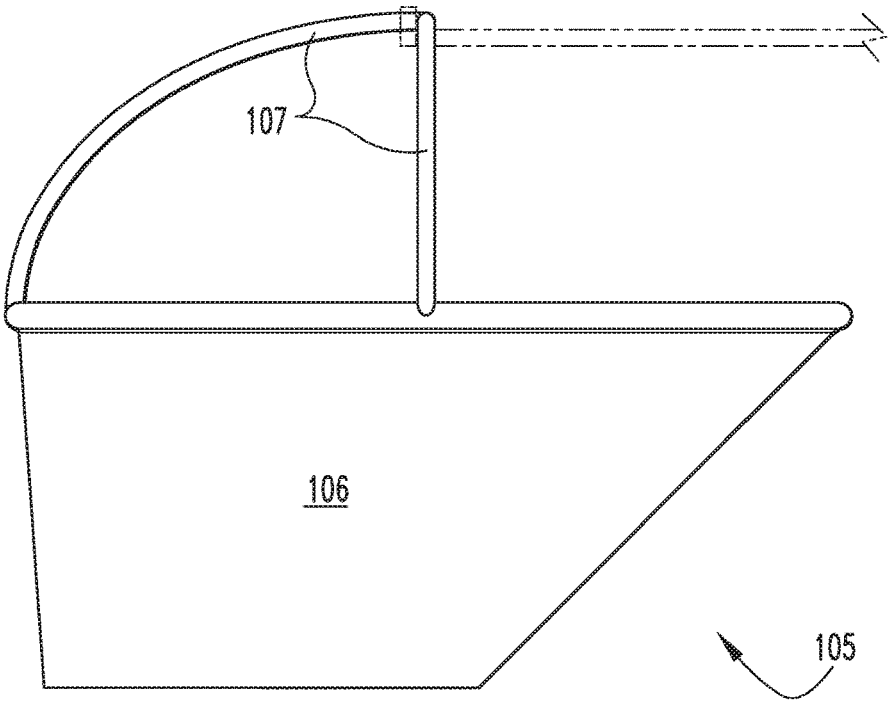
FIG. 10 is a side view of the embodiment of FIG. 9.
Figure 11:
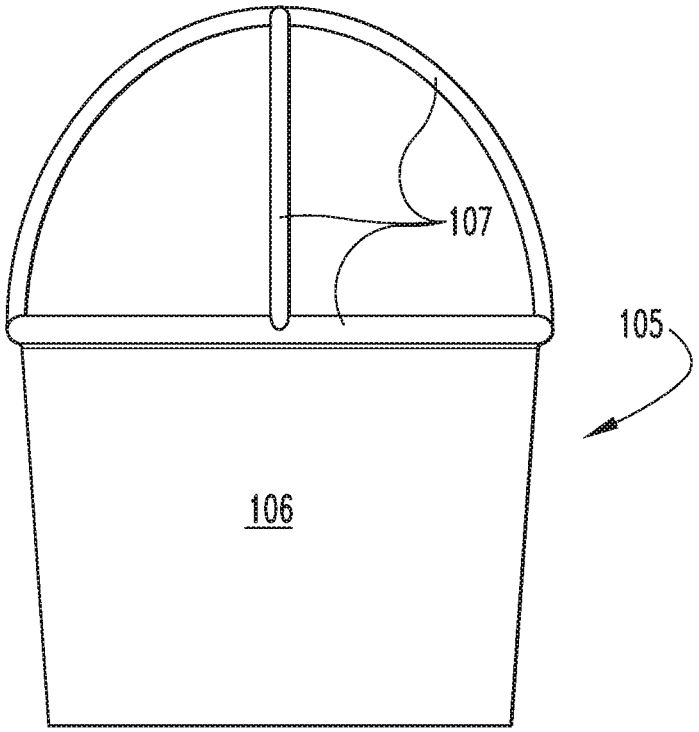
FIG. 11 is another view of the embodiment of FIG. 9.
Figure 12:
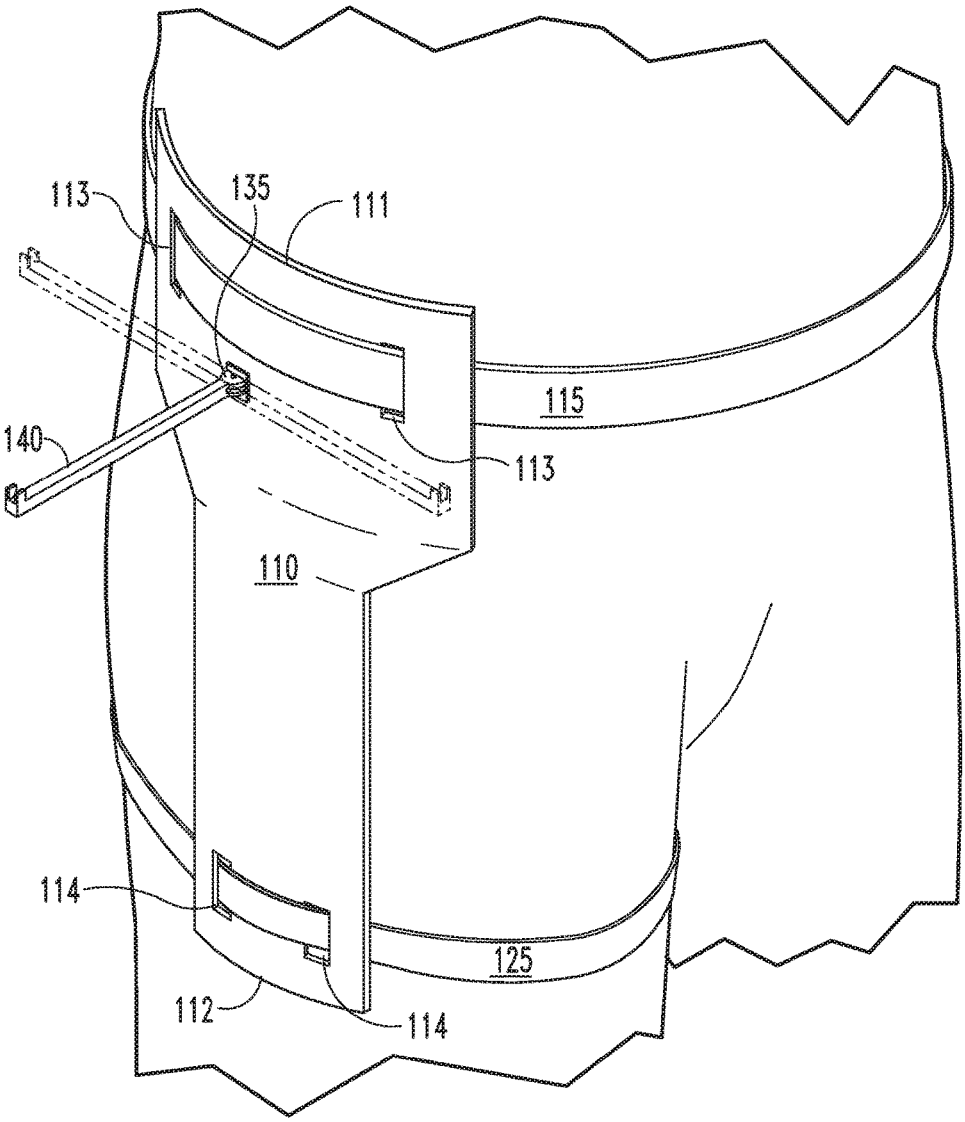
FIG. 12 is a view of the embodiment of FIG. 6.

In an additional embodiment, as illustrated in FIGS. 6-11, the novel technology may be configured to accommodate paint trays as well as paint holders. This paint tray holder apparatus 100 functions substantially the same as the above-described paint cup holder 20 embodiment, and includes a holster portion 110 and a paint tray portion 105 operationally connected to an elongated arm portion 140. The holster portion 110 is typically t-shaped and more typically made of nylon, leather or like material, and is still more typically stiff but still flexible as connected to a user's leg. Near a first end 111 of the holster 110 typically are one or more waist belt apertures 113, through which the user's waist belt 115 may be strung for securing the holster 110 to the user's waist, typically using one or more waist belt connectors 120 (e.g., clasps, hook-and-loop fabric, magnets, and/or the like). Near a typically opposite, second end 112 of the holster 110 typically are one or more leg belt apertures 114, through which a leg belt 125 may be strung for securing the holster 110 to the user's leg, typically at the thigh, typically using one or more leg belt connectors 130 that are typically similar to waist belt connectors 113.

The pivotable elongated member 140 is attached near the top of the holster 110 via a (typically three-position) hinge 135. The hinge 135 allows the elongated member 140 to be pivoted and locked to a number of different positions (typically three), relative to the orientation of the user such as in front of the user 141 (i.e., front/forward position 141), orthogonal to the user 142 (i.e., orthogonal/side position 142), and directly behind the user 143 (i.e., back/rear position 143). A hook 145 typically extends from the end of the elongated member 140 positioned opposite the hinge 135, such as being formed thereupon or connected thereto. In use, the painter hangs the paint tray portion 105 from the hook 145 while painting.

The paint tray portion 105 typically includes an elongated, more typically shallow (between one and two inches deep) elongated paint tray 106, for accommodating a selection of rollers and the like, and a wire hanger 107 positioned about the tray 106. In operation, the painter hangs the tray portion 105 from the elongated member hook 145. This allows the painter use of both hands, such as when climbing a ladder, and/or, while painting, to have one hand securely placed on the ladder. With the other hand, the painter may wield a paintbrush or roller, repetitively refreshing it in the paint, and then painting a desired surface.

In operation, the painter engages of the apparatus 20, 100, with his body, either by clipping the apparatus 20, 100 to their belt, or by securing the holster 110 to their side using the waist and leg belts 115, 125. Once secure, the painter may place a paint can, tray, or like receptacle 25, 105 within the holder system 20. The painter then may climb a ladder; address a surface for painting; coat a brush, roller, or like paint applicator in paint by dipping and/or rolling the applicator in the container; and painting the surface.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A hands-free, belt-worn paint container support apparatus comprising:

a receptacle for holding a paint container;

a handle rotatably connected to the receptacle;

at least one spacer rotatably connected to the handle;

a belt tab connected to the spacer to allow for attachment of the apparatus to a user's belt; and said spacer comprising first and second spaced panels connected by a spacer connector located between them and connected to each spaced panel away from the edges of that spaced panel, the spaced panels connected respectively to the handle and the belt tab such that the spacer spaces the handle from the belt tab;

wherein the handle is rotatably connected to the first panel; and wherein the belt tab is connected to the second panel.

2. The apparatus of claim 1, further comprising a magnet operationally connected to the receptacle for holding a paint brush.

3. The apparatus of claim 1, further comprising:

first and second side pieces operationally connected to the receptacle, wherein each respective side piece extends beyond the receptacle; and wherein the handle is rotatably connected to each respective side piece.

4. The apparatus of claim 1, wherein the paint container is a can.

5. The apparatus of claim 1, wherein the paint container is a tray.

* * * * *